United States Patent [19]

Thompson

[11] Patent Number: 4,587,992

[45] Date of Patent: May 13, 1986

[54] HYDRAULIC RESERVOIR WITH CONTAMINATION SEPARATION

[76] Inventor: Donald E. Thompson, P.O. Box 1036, Hughson, Calif. 95326

[21] Appl. No.: 611,328

[22] Filed: May 17, 1984

[51] Int. Cl.[4] ..... E03B 11/00

[52] U.S. Cl. ..... 137/576; 137/573; 137/587; 137/592; 137/264

[58] Field of Search ..... 137/573, 575, 576, 587, 137/589, 592, 264; 60/592; 220/22

[56] References Cited

U.S. PATENT DOCUMENTS

| | | | |
|---|---|---|---|
| 1,108,603 | 8/1914 | Merrill . | |
| 1,235,438 | 7/1917 | Chynoweth . | |
| 1,530,102 | 3/1925 | Bennet | 137/576 |
| 1,535,462 | 4/1925 | Armknecht | 137/576 |
| 2,047,539 | 7/1936 | Wolf | 137/573 |
| 2,293,263 | 8/1942 | Kornemann et al. | 137/264 |
| 2,651,921 | 9/1953 | Du Rant | 137/575 |
| 3,126,906 | 3/1964 | Touzalin et al. | 137/573 |
| 3,889,705 | 6/1975 | Coderre | 137/574 |
| 3,924,773 | 12/1975 | Wilkinson | 137/587 |
| 3,953,001 | 4/1976 | Gleockler et al. | 137/592 |
| 4,170,877 | 10/1979 | Pickering | 137/574 |
| 4,210,176 | 7/1980 | Emming | 137/573 |

*Primary Examiner*—A. Michael Chambers

*Attorney, Agent, or Firm*—Edward J. Pavsek, Jr.

[57] ABSTRACT

A reservoir for hydraulic fluids and hydrocarbon fluids having an outer tank, an inner tank contained therein, an inlet conduit for the delivery of fluids to the outer tank with a minimum of turbulence, an outlet for withdrawal of fluids from the inner tank, and a vent for venting air into and out of the outer tank.

6 Claims, 2 Drawing Figures

HYDRAULIC RESERVOIR WITH CONTAMINATION SEPARATION

BACKGROUND OF THE INVENTION

1. Field of the Invention

The present invention relates to an improved reservoir for hydraulic fluid or the like and more particularly to such a reservoir which is operable to minimize contamination of hydraulic fluid or the like contained therein and circulated therethrough by contaminants such as air and other gases, condensed water and particulate matter.

2. Description of the Prior Art

The use of reservoirs in hydraulic systems for the containment and supply of hydraulic fluid carried through the delivery and return lines of such systems has long been known. Conventionally, such reservoirs have provided a substantially closed chamber or container adapted to be connected in fluid-flow relation to one or more delivery, suction and return lines through which hydraulic fluid is delivered to the hydraulic system and returned therefrom.

It has long been recognized that the efficacy of a given hydraulic system is, in large part, dependent upon maintaining the fluid contained therein in as uncontaminated a state as possible, whereby deterioration of hydraulic system components is minimized and heat build-up and pressure loss are reduced.

For instance, a problem commonly encountered with many hydraulic systems is the introduction of air bubbles into the hydraulic fluid returned to the reservoir due to the turbulence created within the reservoir by the flow of the fluid thereinto. The air bubbles are commonly difficult to remove and often result in a reduction of pump output as well as a build-up of air pockets or cavities within the system itself.

Similarly, water molecules carried within the hydraulic fluid and dispersed therein have a tendency to condense within the reservoir, particularly when brought into contact with the walls of the reservoir. Such condensation is a result of hydraulic fluid returning from the hydraulic system having a higher temperature relative to both that of the fluid already present in the reservoir and to the walls of the reservoir itself, such that, when brought into contact with the reservoir walls, the water condenses into droplets. The droplets collect and are recirculated and have deleterious affects on the overall functioning and efficiency of the system.

Perhaps the most significant factor in causing damage to hydraulic systems and components and causing consequent debilitation of the overall system is the presence in the hydraulic fluid of contaminating particulate matter. Such particulate matter can consist of, for example, extraneous dirt introduced into the system, the by-products of degradation of the hydraulic fluid itself, or fragments of synthetic materials employed in the valve rings and other components of the hydraulic system. Accumulation of such foreign matter within the reservoir can cause serious damage to the system if and when the particles are recirculated throughout the system, either dispersed or in an agglutinated or flocked mass.

Attempts heretofore made in the art aimed at providing improved hydraulic fluid reservoirs have largely proved unsatisfactory for their intended purposes or have ineffectively addressed the three sources of systemic and fluid contamination discussed above. Therefore, it has long been known that it would be desirable to have an improved reservoir for hydraulic fluids and liquids capable of reducing or substantially eliminating the contamination of hydraulic fluid by air, particulate matter, and condensed moisture with an effectiveness and dependability heretofore unattainable.

SUMMARY AND OBJECTS OF THE INVENTION

It is therefore an object of the present invention to provide an improved hydraulic fluid reservoir adapted for use in conjunction with myriad hydraulic systems of varying function, structure and capacity.

Another object is to provide such a reservoir which is operable to reduce the amount of air bubbling and turbulence caused by the flow of hydraulic fluid thereinto.

Another object is to provide such a reservoir which is adapted to segregate and contain accumulated air and automatically to release such air from the reservoir to avoid contamination of the hydraulic fluid thereby.

Another object is to provide such a reservoir which is adapted to reduce the amount of condensed moisture dispersed within the hydraulic fluid of a hydraulic system.

Another object is to provide such a reservoir which is adapted automatically to remove significant quantities of particulate matter from hydraulic fluid prior to the exiting of such fluid from the reservoir for use in a hydraulic system attached thereto.

Another object is to provide such a reservoir which causes such particulate matter to accumulate in a segregated portion thereof for easy removal of the particulate matter from the reservoir.

Another object is to provide such a reservoir which is characterized by simplicity of construction, durability of design and effectiveness of operation and which can be manufactured and sold for a nominal price.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 2:
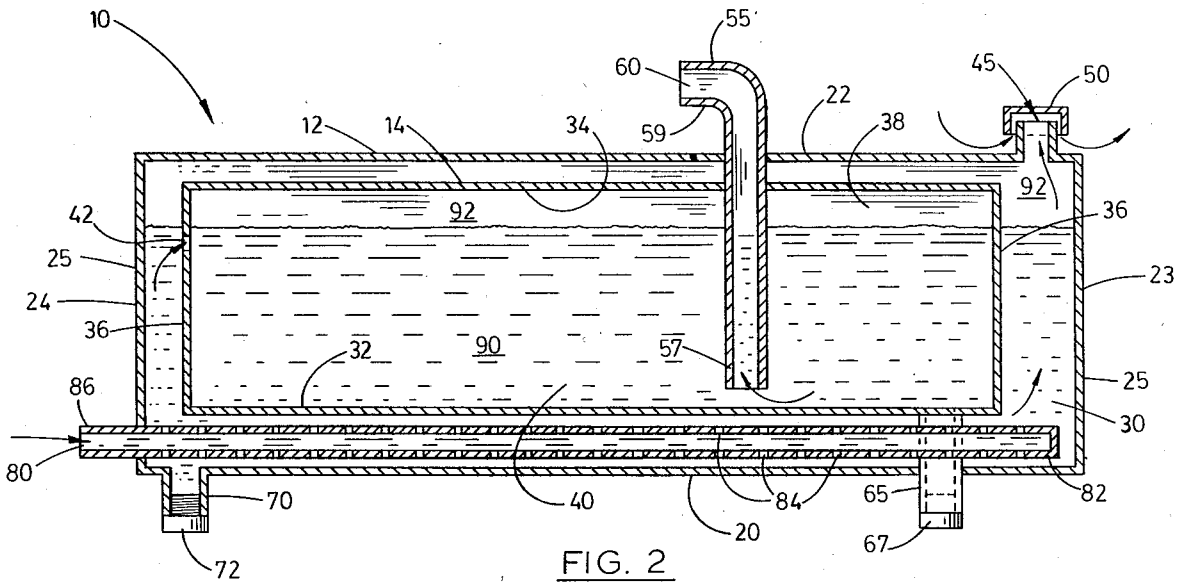
FIG. 2 is a longitudinal section taken on line 2—2 in FIG. 1.
Figure 1:
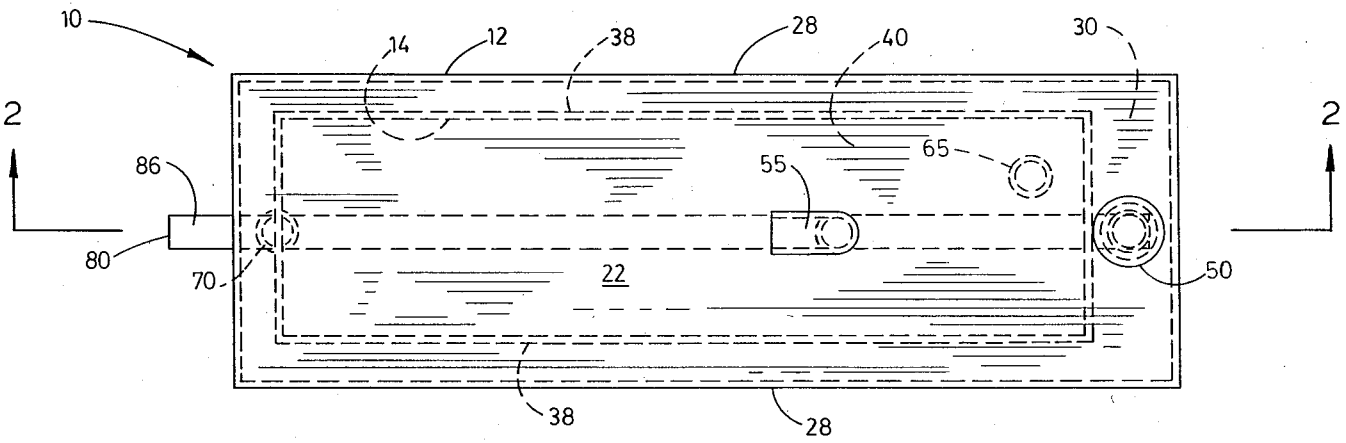
FIG. 1 is a top plan view of the hydraulic fluid reservoir of the preferred embodiment of the present invention.

Referring more particularly to the drawings, the hydraulic fluid reservoir embodying the principles of the present invention is generally indicated by the numeral 10 in FIGS. 1 and 2.

As shown therein, the reservoir generally provides a first, or outer container or tank 12 of substantially box-like configuration and a second, or inner container or tank 14 completely within the outer tank 12 and of a generally similar configuration.

The outer tank 12 provides a substantially rectangular bottom panel 20 and a substantially rectangular upper panel 22 spaced therefrom. The outer tank has a first end portion 23 and an opposite, second end portion 24. Substantially rectangular end walls 25 interconnect the bottom panel 20 and upper panel 22 along their respective endmost edges. Side walls 28 of substantially rectangular configuration extend longitudinally along the outer tank 12 and interconnect the bottom panel 20 and upper panel 22 respectively along their sidemost edges. The configuration of the outer tank 12 is thus generally box-like, although it will be recognized that the configuration can be varied substantially within the concepts of the invention. Further, it will be seen that the outer tank 12 provides an inner chamber 30 of a predetermined volume bounded by the bottom panel 20, upper panel 22, endwalls 25 and sidewalls 28.

The inner tank 14 provides a substantially rectangular bottom panel 32 and a substantially rectangular upper panel 34 spaced therefrom. The inner tank further provides subtantially rectangular endwalls 36 spaced longitudinally of each other at opposite ends of the inner tank and substantially rectangular sidewalls 38 spaced transversely of each other. The inner tank 14 thus is substantially box-like in configuration and provides an inner chamber 40 bounded by the bottom panel 32, upper panel 34, endwall 36 and sidewalls 38. Conduit means, including at least one bore 42 are provided in a predetermined endwall 36, preferably the endwall nearest the second end portion 24 of the outer tank 12, in fluid-flow communicating relation between the inner chamber 40 of the inner tank 14 and the inner chamber 30 of the outer tank 12. The bore 42 is spaced a predetermined distance from the bottom panel 32 and upper panel 34, as is discussed more fully below.

The inner tank 14 is supported by appropriate means as by legs or the like (not shown) to retain the inner tank in fixed spaced relation from the outer tank 12 along its bottom panel 32, upper panel 34, endwalls 36 and sidewalls 38 to permit the substantially unobstructed flow of fluids about the inner tank 14 within the inner chamber 30 of the outer tank 12.

The outer tank 12 provides vent means including an upwardly projecting pipe portion 45 or the like on its upper panel 22 in proximity to the first end portion 23 thereof in fluid-flow communicating relation between the inner chamber 30 and the external environment. A vented cap member 50 is removably secured on the pipe portion 45 in incomplete sealing relation thereto. As is discussed in greater detail below, the cap member 50, which is of conventional design and construction, serves the dual purpose of acting as a vent to permit the flow of air into and out of the inner chamber 30 and, when removed, to permit access to the pipe portion 45 for the introduction of hydraulic fluid or the like into the inner chamber 30. Preferably, the pipe portion 45 is disposed on the upper panel 22 in a position whereby fluid introduced therethrough into the inner chamber 30 can readily be caused to flow free of engagement with the upper panel 34 of the inner tank 14. Further, preferably, although not necessarily, the pipe portion 45 and the bore 42 of the inner tank 14 are spaced remotely from each other.

The reservoir 10 further provides an outlet member or suction line member 55 having a first, intake end portion 57 disposed within the inner chamber 40 of the inner tank 14 in substantial proximity to the bottom panel 32 thereof and an opposite, exit end portion 59 disposed externally of the upper panel 22 of the outer tank 12. The suction line member 55 provides a bore or passage 60 communicating between the intake end portion 57 and the exit end portion 59 to permit the flow of fluid between the inner chamber 40 of the inner tank 14 and the external environment. The exit end portion 59 is adapted to be connected by conventional means in fluid flow relation to a hydraulic pump, suction line, or the like.

A drain member 65 extends from the bottom panel 32 of the inner tank 14 through the bottom panel 20 of the outer tank 12 to permit the flow of fluid, as by gravity, from the inner chamber 40 to the external environment. The drain member 65 provides a conventional seal or cap 67 removably mounted thereon and adapted conventionally to occlude the drain 65 to prevent fluid flow therethrough and, when removed, to permit such fluid flow.

The outer tank 12 provides a drain member 70 communicating through the bottom panel 20 thereof in fluid-flow communicating relation between the inner chamber 30 and the external environment. A plug or cap 72 is removably secured on the drain member 70 and is adapted selectively to be removed therefrom to permit the draining, as by gravity, of fluid from the inner chamber 30.

The reservoir 10 provides an inlet member or return tube or line 80 inserted through the endwall 25 of the second end portion 24 of the outer tank 12 and extended longitudinally within the inner chamber 30 toward the first end portion 23. The return line member 80 has an end portion 82 preferably disposed longitudinally between the endwall 36 and endwall 25 nearest the first end portion 23. The return line member 80 is preferably, although not necessarily, of tubular conduit construction and is disposed intermediate the bottom panel 20 of the outer tank 12 and the bottom panel 32 of the inner tank 14. The return line member provides a multiplicity of perforations 84 communicating radially therethrough substantially along the entirety of its length internal of the inner chamber 30. The perforations 84 are adapted to permit the flow of fluid therethrough into the inner chamber 30. The return line member 80 provides an opposite or external end portion 86 external of the reservoir 10 and adapted to be connected in fluid-flow relation to a return line of a conventional hydraulic system by appropriate means.

OPERATION

The operation of the described embodiment of the present invention is believed readily apparent and is briefly summarized at this point.

For use as a reservoir for hydraulic fluid in a hydraulic system having a pump, delivery and return lines, and hydraulically-operated portions such as hydraulic rams or the like, the reservoir is first connected in fluid-flow relation to the appropriate portions of the hydraulic system. The exit end portion 59 of the suction line member 55 is connected in fluid-flow relation by appropriate means to a flow line leading to a hydraulic pump. Similarly, the external end portion 86 of the return line member 80 is connected in receiving fluid-flow relation to a return line of the hydraulic system whereby used hydraulic fluid can be returned to the reservoir.

The plug member 72 of the drain portion 70 of the outer tank 12 is secured in sealing relation on the drain portion. The cap portion 67 of the drain portion 65 of the inner tank 14 is also secured in sealing relation to the drain portion thereof.

The cap member 50 of the pipe portion 45 of the outer tank 12 is removed and a volume of hydraulic fluid 90 appropriate for the needs of the system is poured or otherwise introduced into the inner chamber 30 of the outer tank 12. Hydraulic fluid so introduced into the inner chamber 30 will arise within the inner chamber until the level of the fluid reaches the level at which the bore 42 is disposed on the endwall 36 of the inner tank 14. At that point, the hydraulic fluid will begin to pour into the inner chamber 40 of the inner tank 14 and will continue to do so until the fluid level within the inner chamber 40 has reached the level of the bore 42. Subsequent introduction of additional hydraulic fluid will cause the level of the fluid within the inner chamber 30 and inner chamber 40 to equilibrate whereby the fluid level is substantially even throughout both chambers. As discussed previously, the bore 42 is spaced between the bottom panel 32 and upper panel 34 of the inner tank 14 a predetermined distance. Preferably, although not necessarily, the bore will be positioned at the desired low fluid level within the reservoir 10, that is, the lowest level representing a fluid volume minimally required for the optimum performance and needs of the hydraulic system. Contained within the inner chamber 30 of the outer tank 12 and inner chamber 40 of the inner tank 14 will be an air space 92 of a volume dictated by the volume of hydraulic fluid 90 contained therein.

As the pump (not shown) is operated in the hydraulic system, hydraulic fluid is withdrawn from the inner chamber 40 of the inner tank 14 through the suction line member 55 thus effecting a reduction in the volume of the fluid in the inner chamber 40, which will be at least partially replaced by the drawing in of fluid from the inner chamber 30 of the outer tank 12 through the bore 42. Hydraulic fluid previously used by and circulated through the hydraulic system is returned through the return line member 80 and is dispersed through the perforations 84 thereof into the inner chamber 30. It will be evident from FIG. 2, that above the hydraulic fluid level within the reservoir 10 will be the air space 92 which will be of moderately variable volume. The withdrawl and reintroduction of hydraulic fluid from and to the reservoir 10 will effect changes in the volume of the air space and in order to prevent pressure build-up or the creation of a vacuum, either of which could be detrimental to the overall functioning of the reservoir and the hydraulic system, air is vented into and out of the inner chamber 30 through the cap member 50 of the pipe portion 45.

Contamination of fluid drawn from the inner tank 14 for use within the hydraulic system is substantially avoided in three ways. First, when the reservoir is filled or replenished by hydraulic fluid supplied through the return line portion 80, particulate matter in such fluid tends to gravitate toward the bottom panel 20 within the inner chamber 30 of the outer tank 12. The perforations 84 in the return line member 80 assure that turbulence of the fluid returning to the inner chamber 30 is minimized by a more even dispersion of the fluid within the inner chamber 30. Further, due to the relatively passive flow of fluid from the inner chamber 30 through the bore 42 into the inner chamber 40 of the inner tank 14 the chances of particulate contaminants being drawn into the inner chamber 40 are minimized.

The perforations 84 of the return line portion 80 serve the second purpose of reducing the velocity of fluid flowing into the inner chamber 30. This reduction of velocity, combined with the relative lack of turbulence and agitation of the fluid, facilitates the escape of air bubbles which might otherwise be trapped within the fluid by the turbulence. Such air bubbles then, by natural buoyancy, float upward through the fluid into the air space and from the reservoir through the cap member 50.

Finally, as discussed previously, it is well known that hydraulic fluid returning from the hydraulic system through the return line 80 will have a tendency to be of a greater temperature than that within the reservoir 10 and will often contain dispersed moisture therein. Contact by the hydraulic fluid with the relatively cooler reservoir walls and relatively cooler hydraulic fluid in the reservoir causes the moisture to condense into droplets which would have undesirable effects on the operation of the system if recirculated through the suction line member 55. However, in operation, the reservoir 10 of the present invention permits such condensation to occur between the bottom panels 20 and 32 and to a limited extent, between the sidewalls 28 and 38 and the endwalls 25 and 36, respectively, whereby direct contamination of hydraulic fluid within the inner tank 14 by such moisture is minimized and much of such moisture is permitted to evaporate into the air space and be substantially drawn out as air is vented through the cap member 50. Again, disposing the bore 42 in spaced relation between the bottom panel 32 and upper panel 34 of the inner tank 14 such that the low fluid level of the reservoir is maintained at a level at or above the level of the bore 42 further facilitates the evaporative transportation of separated moisture from the hydraulic fluid without the substantial risk of contamination of the fluid in the inner tank 14.

Therefore, the hydraulic reservoir of the present invention is seen as an effective and readily utilizable substitute component adapted to be used in a wide variety of conventional hydraulic systems to reduce or eliminate contamination of hydraulic fluid within the system from air, condensed moisture and particulate matter. Further the reservoir is capable of assisting in prolonging the overall life of a hydraulic system to which it is connected, and the components thereof, by reducing the overall presence of contaminating agents having known deleterious effects.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A fluid reservoir comprising:

a first container having predetermined bottom portion; a predetermined upper portion spaced from the bottom portion; and side portions interconnecting the bottom and upper portions to define a substantially closed internal chamber of predetermined volume adapted to contain fluids;

a second container disposed within said internal chamber and having a predetermined bottom portion; a predetermined upper portion spaced therefrom; and side portions interconnecting the bottom and upper portions to define a substantially closed internal cavity of predetermined volume adapted to contain fluids, the side portions providing at least one conduit to permit the flow of fluids between the inner chamber of the first container and the internal cavity of the second container;

an inlet member mounted by the first container having an internal portion extended into the internal chamber and an external portion adapted to be connected in fluid-flow relation to a source of fluids for the delivery of such fluids to the internal chamber; and an elongated outlet member providing a bore longitudinally therethrough and having an internal portion disposed within the internal cavity of the second container and an external portion disposed externally of the first container and adapted for connection in fluid-flow relation to means for creating a fluid demand to draw fluid from the internal cavity through the bore of the outlet member.

2. The reservoir of claim 1 wherein the upper portion of the first container is spaced from the upper portion of the second container; the bottom portion of the first container is spaced from the bottom portion of the second container; and the side portions of the first container are spaced from the side portions of the second container; whereby the flow of fluids contained by the first container about the second container is substantially unobstructed.

3. A reservoir for fluids comprising a first tank portion having having walls bounding an inner chamber adapted to contain fluids; a second tank portion internal of the first tank portion having walls spaced from the walls of the first tank portion to permit the circulation of fluid therebetween, the walls of the second tank portion bounding an internal chamber adapted to contain fluids, and conduit means for permitting the flow of fluids from the first tank portion to the internal chamber of the second tank portion upon the accumulation of a predetermined volume of fluid in the first tank portion; an inlet member disposed in fluid-flow relation with the first tank portion and defining a flow path initially to conduct fluids from a fluid source external of the first tank portion into the first tank portion for accumulation of such fluids within the first tank portion before the flow thereof to the internal chamber of the second tank portion; an outlet member remote from the inlet member having a portion disposed internally of the internal chamber of the second tank portion and adapted to be connected in fluid-flow relation to pump means for creating a fluid demand external of the first tank portion for the withdrawal of fluids from the internal chamber; and vent means for permitting the flow of air into and out of the first tank portion.

4. The reservoir of claim 3 wherein the first tank portion provides a predetermined upper portion and a lower portion spaced therefrom; the inlet member is disposed in substantial proximity to the lower portion; and the conduit means are disposed intermediate the inlet member and the upper portion of the first tank portion.

5. The reservoir of claim 4 wherein the first tank portion provides a first end portion and an opposite, second end portion spaced remotely therefrom; the inlet member is elongated and extends from the second end portion toward the first end portion; and the conduit means are disposed remotely from the first end portion.

6. A fluid reservoir comprising:

a first container having a predetermined bottom portion; a predetermined upper portion spaced from the bottom portion; and side portions interconnecting the bottom and upper portions to define a substantially closed internal chamber of predetermined volume adapted to contain fluids; a second container disposed within said internal chamber and having a predetermined bottom portion spaced from the bottom portion of the first container; a predetermined upper portion spaced therefrom and spaced from the upper portion of the first container; and side portions interconnecting the bottom and upper portions to define a substantially closed internal cavity of predetermined volume adapted to contain fluids, the side portions being spaced from the side portions of the side portions of the first container, whereby the flow of fluids contained by the first container about the second container is substantially unobstructed, the side portions providing at least one conduit to permit the flow off fluids between the inner chamber of the first container and the internal cavity of the second container, said at least one conduit being spaced a predetermined distance from the bottom portion of the second container whereby fluids of volumes exceeding a predetermined volume introduced into the internal chamber of the first container will flow into the second container;

an elongated tubular conduit having an internal portion extending betwen the bottom portions of the first and second containers and an external portion external of the first container adapted to be connected in fluid flow relation to a source of fluids for the delivery of such fluids to the internal chamber of the first container, the internal portion of the conduit providing a plurality of apertures transversely therethrough spaced longitudinally of each other to permit the flow of fluids radially thereof to the internal chamber; and vent means provided by the upper portion of the first container for permitting the flow of air into and out of the internal chamber of the first container.

* * * * *